US006260375B1

(12) United States Patent
Kuo

(10) Patent No.: US 6,260,375 B1
(45) Date of Patent: Jul. 17, 2001

(54) AIR CONDITIONER BLOWING COOL AIR TO MANY DIRECTIONS

(76) Inventor: Chin-Sheng Kuo, P.O. Box 90, Tainan City (TW)

( * ) Notice: Subject to any disclaimer, the term of this patent is extended or adjusted under 35 U.S.C. 154(b) by 0 days.

(21) Appl. No.: 09/590,373

(22) Filed: Jun. 9, 2000

(51) Int. Cl.[7] ..... F25D 17/04; F24F 13/08

(52) U.S. Cl. ..... 62/407; 454/234; 454/248

(58) Field of Search ..... 62/426, 407, 408, 62/418; 454/234, 235, 241, 248, 244, 249, 354, 359, 349, 364

(56) References Cited

U.S. PATENT DOCUMENTS 5,934,362 * 8/1999 Barker, II .

FOREIGN PATENT DOCUMENTS

10238802-A * 9/1998 (JP) .

* cited by examiner

*Primary Examiner*—Henry Bennett
*Assistant Examiner*—Chen-Wen Jiang

(57) ABSTRACT

An air conditioner blowing cool air to many directions includes a housing having a hollow chamber, a face plate formed in a bottom of the housing. The face plate has a wind inlet and plural wind outlets. A wind box is provided on the wind inlet and in the hollow chamber of the housing. The housing and the wind box both have a windpipe connected to a wall and then the windpipe is connected to the air conditioner. Thus a single air conditioner can blow cool air to every corner of a room by means of the wind outlets, having at the same time functions of wind blowing and wind returning, with its cost reduced.

1 Claim, 4 Drawing Sheets

AIR CONDITIONER BLOWING COOL AIR TO MANY DIRECTIONS

BACKGROUND OF THE INVENTION

This invention relates to an air conditioner blowing cool air to many directions, particularly to one having a wind inlet and plural wind outlets formed in a bottom face plate of a housing of an air conditioner installed in a room, blowing cool air produced by the air conditioner to many directions from the wind outlets, having function of wind blowing and wind returning, with the cost reduced.

Common conventional air conditioners generally includes several cool air outlets 10 and inlets 11 provided in a ceiling of a room to blow cool air to every corner of the room. But every outlet 10 and every inlet 11 have to be connected to the air conditioner body with bellow leading pipes made of aluminum paper, requiring much work and time. Provision of many outlets 10 and inlets 11 costs much expenditure to blow cool air to everywhere in a room. In addition, the wind outlets 11 are generally not connected to the air conditioner by leading pipes for filtering dirty air, reducing cooling or cleaning air effect.

SUMMARY OF THE INVENTION

This invention has been devised to offer an air conditioner blowing cool air to many directions, having function of both blowing out cool air to every corner and wind returning.

The feature of the invention is plural wind outlets and a wind inlet formed in a faceplate of a bottom of a housing of the air conditioner, with the wind inlet provided with a filter net and a decorative frame, with each wind outlet having plural adjustable direction strips. Further, a wind box is provided on the wind inlet and in the hollow chamber of the housing of the air conditioner. Then cool air produced by the air conditioner can be blown to every corner of a room by means of the plural wind outlets.

BRIEF DESCRIPTION OF DRAWINGS

This invention will be easily understood by referring to the accompanying drawings, wherein.

DETAILED DESCRIPTION OF THE PREFERRED EMBODIMENTS

Figure 1:
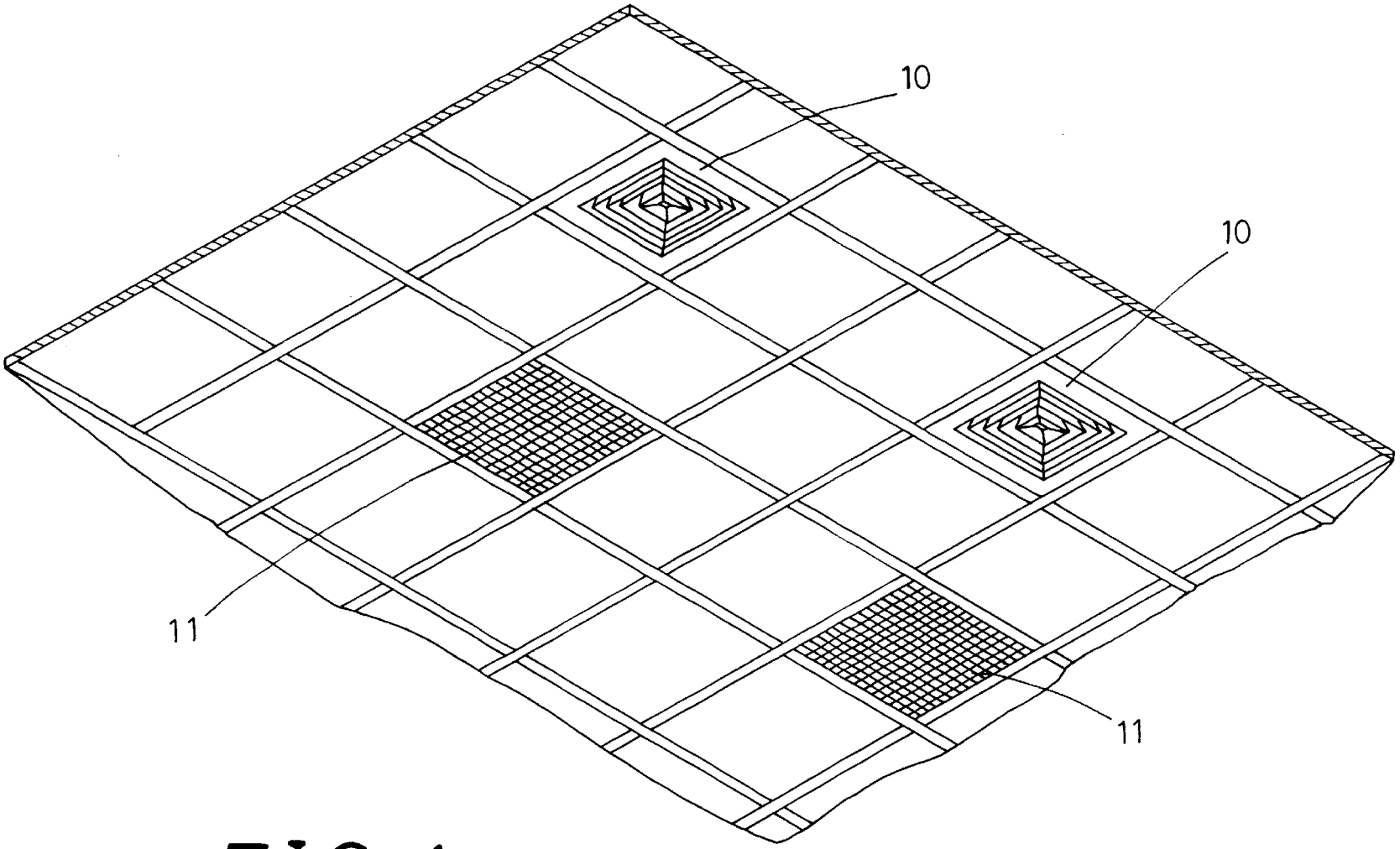
FIG. 1 (PRIOR ART)
FIG. 1 is a perspective view of wind inlets and wind outlets of a conventional air conditioner provided on a ceiling.
Figure 2:
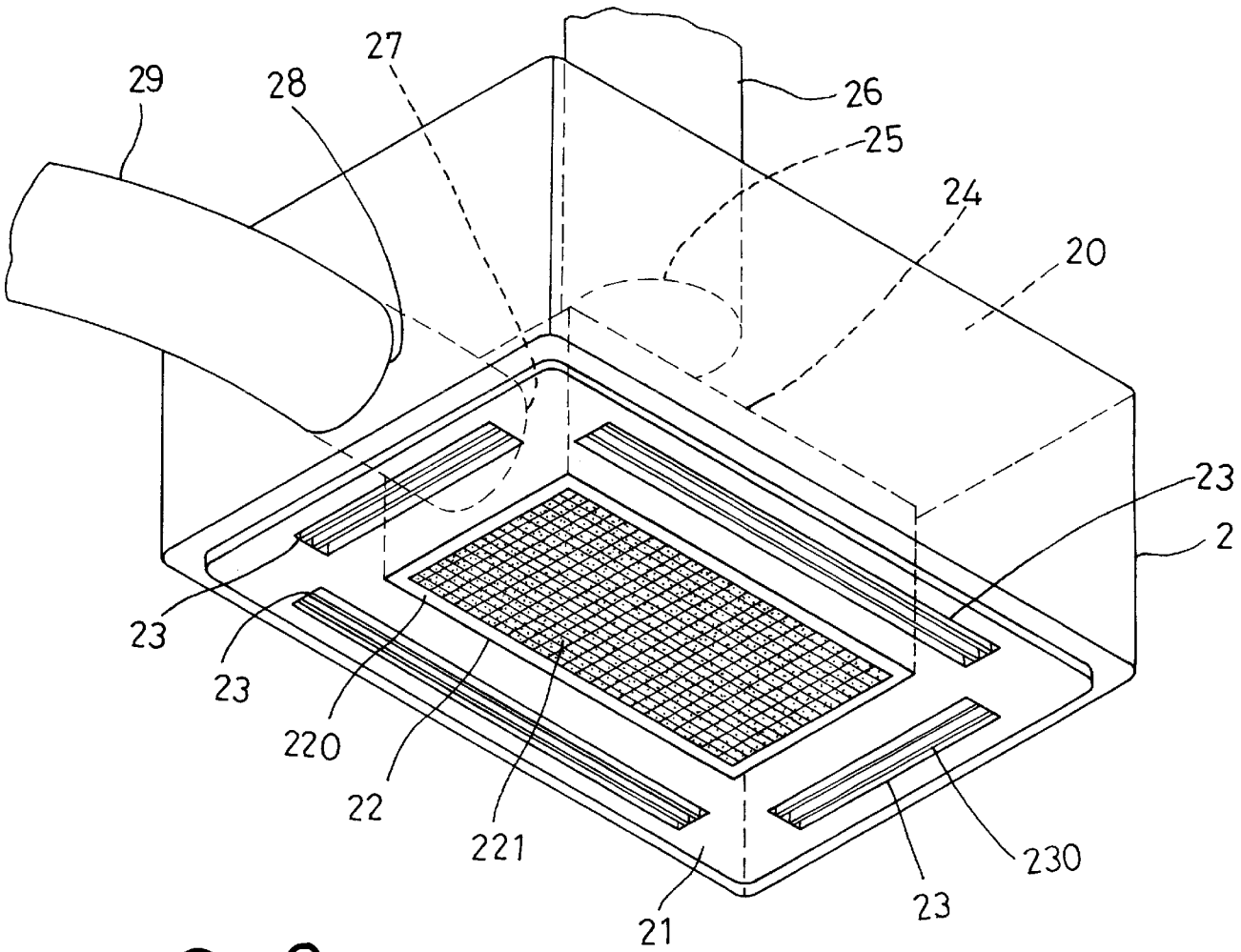
FIG. 2 is a perspective view of an air conditioner blowing cool air in many directions in the present invention.
Figure 3:
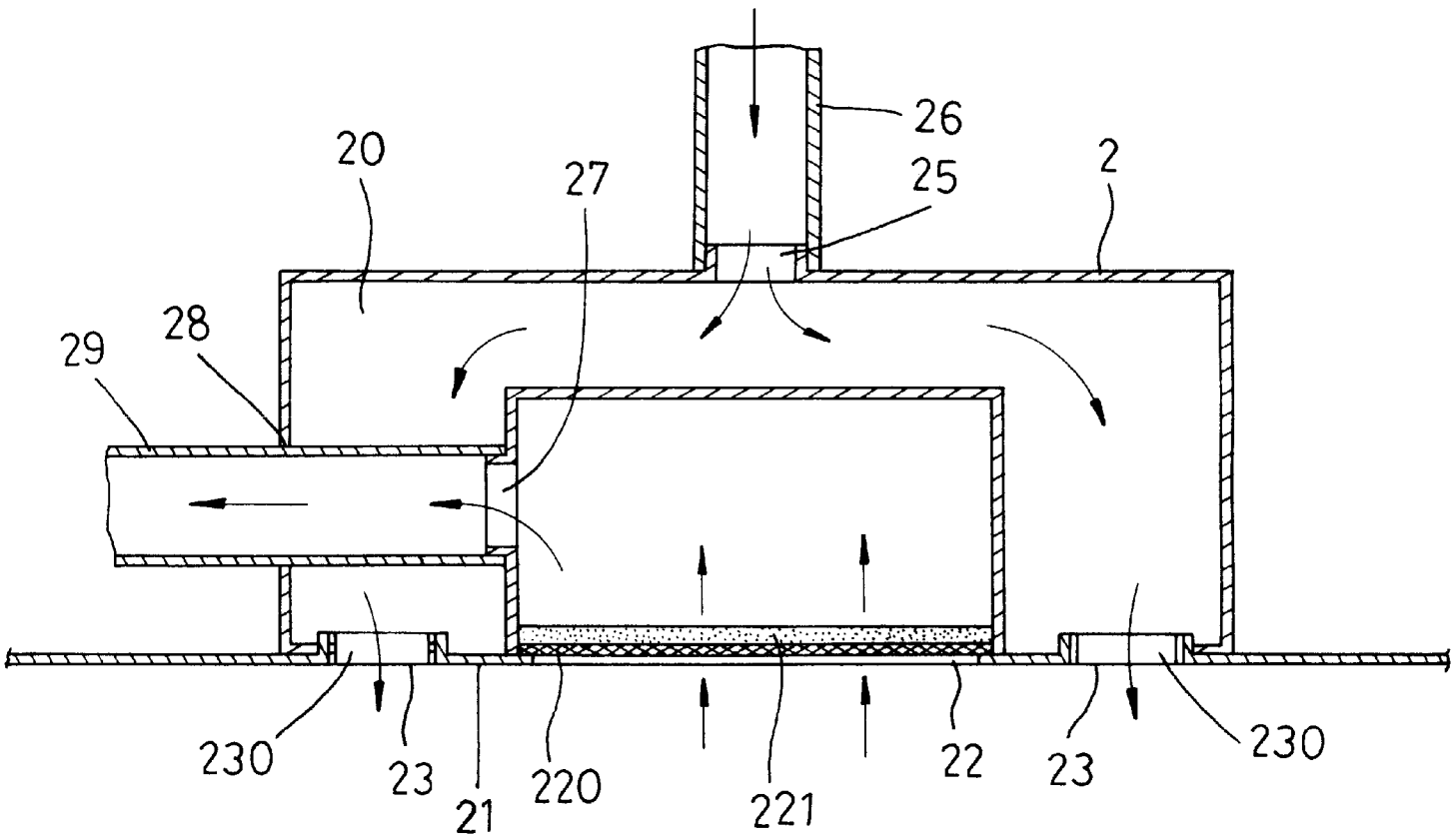
FIG. 3 is a cross-sectional view of the air conditioner blowing cool air in many directions in the present invention; and, FIG. 4 is another embodiment of an air conditioner blowing cool air in many directions in the present invention.

A preferred embodiment of an air conditioner blowing cool air to many directions in the present invention, as shown in FIGS. 2 and 3, includes a housing 2, a hollow chamber 20 in the housing 2, a face plate 21 formed in a bottom, a wind inlet 22 formed in a center portion of the face plate 21, a decorative frame 220 fixed around the wind inlet 22, a filter net 221 fixed with the decorative frame 220, a wind outlet 23 respectively formed at four corners of the face plate 21, each wind outlet 23 having plural direction adjusting strips 230, a hole 25 bored above the wind inlet 22 connected to a bellow-shaped pipe 26. Further, a wind box 24 is positioned in the hollow chamber 20, having a hole 27 in its wall facing a wall of the housing 2, and the wall of the housing 2 also has a hole 28 corresponding to the hole 27 connected to a bellow-shaped pipe 28 extending out of the hole 28 of the wall of the housing 2.

In assembling and using, referring to FIGS. 2 and 3, the air conditioner is installed on a steel frame fixed with a ceiling, and then the bellow-shaped pipe 26 sends cool air coming out of the air conditioner to the hollow chamber 20 of the housing 2. Then the wind box 24 is filled with cool air, which then flows out of the wind outlets 23, with the direction adjusted strips 230 of each wind outlet 23 so as to let cool air blown evenly to every corner of a room. Dirty air in the room flows through the wind inlet 22 and through the filter net 221 and then enters the wind box 24 in the hollow chamber 20 of the body 2 and then flows out through the bellow-shaped pipe 29 into the room again. Thus the air in the room can be cooled and kept clean as well. Therefore, only one air conditioner is enough to keep cool the air in one room.

In addition, only one bellow-shaped pipe 26 is enough for the wind outlets and only one bellow-shaped pipe 29 is enough for the wind inlet 22, so many bellow-shaped pipes may not occupy the interior of the ceiling. Therefore, the air conditioner in the invention can be installed easily and conveniently, with no need of many wind outlets and wind inlets like the conventional ones, reducing its cost greatly.

Figure 4:
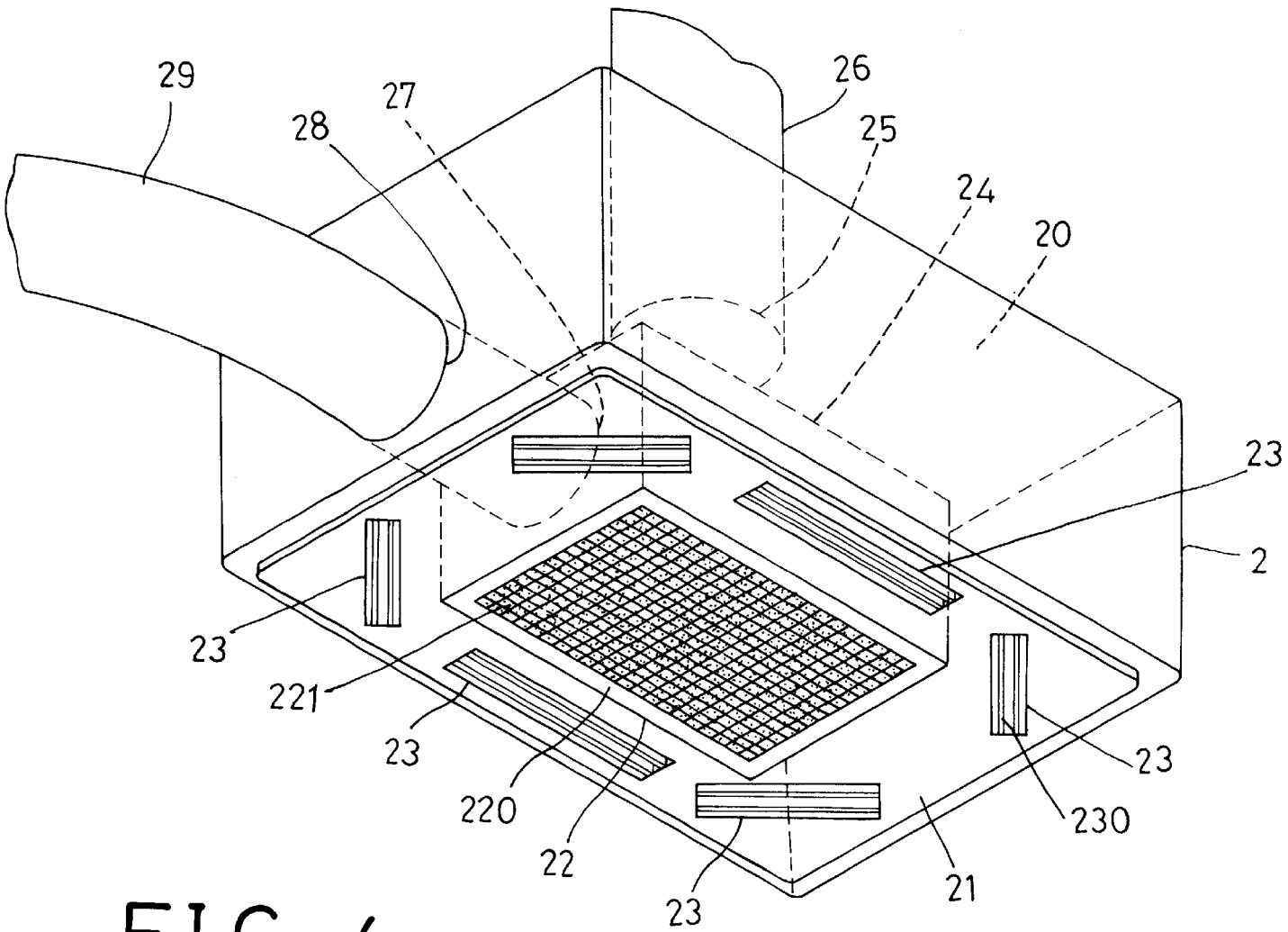

In addition, the four wind outlets 23 in the faceplate 21 may be increased to six or more ones as shown in FIG. 4, to attain the objective of blowing cool air to much more directions.

The invention has the following advantages to be understood from the above description.

1. Installing only one air conditioner can have effect of blowing wind and wind returning, with the cost reduced largely.

2. A single air conditioner has many wind outlets with direction adjusting strips for adjusting the direction of blowing cool air to every corner of a room.

3. Its installation is simple and convenient.

While the preferred embodiment of the invention has been described above, it will be recognized and understood that various modifications may be made therein, and the appended claims are intended to cover all such modifications that may fall within the spirit and scope of the invention.

What is claimed is:

1. An air conditioner comprising a housing having a hollow chamber, a face plate formed in a bottom of said housing, said face plate having a wind inlet in the center portion and plural wind outlets located at four corner, said wind inlet fixed around with a decorative frame and a filter net, each said wind outlet having plural adjustable direction strips, a wind box provided on said wind inlet, said wind box located in said hollow chamber of said housing, said housing and said wind box both having a hole in their wall respectively connected to a pipe connected to said air conditioner; thus installation a single air conditioner capable to blowing cool air to every corner of a room by means of said wind outlets, also having functions of wind returning and blowing, with its cost reduced greatly.

* * * * *